US006696802B1

(12) United States Patent
Lezcano et al.

(10) Patent No.: US 6,696,802 B1
(45) Date of Patent: Feb. 24, 2004

(54) RADIO FREQUENCY DRIVEN ULTRA-VIOLET LAMP

(75) Inventors: Pedro A. Lezcano, Gaithersburg, MD (US); Jonathan D. Barry, Frederick, MD (US); Jeffrey K. Okamitsu, Westminster, MD (US); Miodrag Cekic, Bethesda, MD (US)

(73) Assignee: Fusion UV Systems Inc., Gaithersburg, MD (US)

( * ) Notice: Subject to any disclaimer, the term of this patent is extended or adjusted under 35 U.S.C. 154(b) by 0 days.

(21) Appl. No.: 10/225,415

(22) Filed: Aug. 22, 2002

(51) Int. Cl.[7] ..... H05B 41/16
(52) U.S. Cl. ..... 315/248; 315/267; 315/344
(58) Field of Search ..... 315/248, 39, 267, 315/344; 313/234, 634

(56) References Cited

U.S. PATENT DOCUMENTS

| | | | | |
|---|---|---|---|---|
| 3,568,111 A | | 3/1971 | Dyer et al. | 333/97 |
| 3,873,884 A | * | 3/1975 | Gabriel | 315/267 |
| 4,048,541 A | * | 9/1977 | Adams et al. | 315/248 |
| 4,049,940 A | | 9/1977 | Moisan et al. | 219/10.55 R |
| 4,204,834 A | | 5/1980 | Fohl | 431/362 |
| 4,379,977 A | | 4/1983 | Carmel et al. | 378/136 |
| 4,792,725 A | | 12/1988 | Levy et al. | 315/39 |
| 4,810,933 A | | 3/1989 | Moisan | 315/39 |
| 4,812,702 A | * | 3/1989 | Anderson | 313/153 |
| 4,887,008 A | | 12/1989 | Wood | 315/39 |
| 5,063,333 A | | 11/1991 | Linden-Smith et al. | 315/326 |
| 5,070,277 A | | 12/1991 | Lapatovich | 315/248 |
| 5,072,157 A | | 12/1991 | Greb et al. | 315/248 |
| 5,113,121 A | * | 5/1992 | Lapatovich et al. | 315/248 |
| 5,130,612 A | | 7/1992 | Lapatovich et al. | 315/248 |
| 5,280,217 A | | 1/1994 | Lapatovich et al. | 315/39 |
| 5,306,987 A | | 4/1994 | Dakin et al. | 315/248 |
| 5,367,226 A | | 11/1994 | Ukegawa et al. | 315/248 |
| 5,504,391 A | | 4/1996 | Turner et al. | 313/570 |
| 5,686,793 A | | 11/1997 | Turner et al. | 313/570 |
| 5,747,945 A | | 5/1998 | Ukegawa et al. | 315/248 |
| 5,834,905 A | * | 11/1998 | Godyak et al. | 315/248 |
| 5,886,478 A | | 3/1999 | Smith et al. | 315/248 |
| 5,923,116 A | | 7/1999 | Mercer et al. | 313/113 |
| 5,990,632 A | | 11/1999 | Smith et al. | 315/248 |
| 6,046,545 A | | 4/2000 | Horiuchi et al. | 315/39 |
| 6,107,752 A | | 8/2000 | Palmer et al. | 315/246 |
| 6,118,226 A | | 9/2000 | Kohne et al. | 315/248 |
| 6,137,237 A | | 10/2000 | MacLennan et al. | 315/248 |
| 6,145,979 A | | 11/2000 | Caiger et al. | 347/102 |
| 6,248,805 B1 | | 6/2001 | Nguyen et al. | 523/160 |
| 6,249,090 B1 | | 6/2001 | Popov et al. | 315/248 |

FOREIGN PATENT DOCUMENTS

| | | |
|---|---|---|
| EP | 0 225 753 | 6/1987 |
| GB | 2 248 974 A | 4/1992 |
| JP | 9-237608 | 9/1997 |
| JP | 10-188911 | 7/1998 |
| JP | 2000-182569 | 6/2000 |
| WO | WO 97/07559 | 2/1997 |
| WO | WO 01/03161 | 1/2001 |

* cited by examiner

*Primary Examiner*—Don Wong
*Assistant Examiner*—Thuy Vinh Tran
(74) *Attorney, Agent, or Firm*—Antonelli, Terry, Stout & Kraus, LLP

(57) ABSTRACT

A lamp assembly in accordance with the invention includes an electrodeless bulb (14) which is symmetrical about an axis (16) and which contains a light emissive fill which emits light when the bulb is excited by a RF electrical field coupled to the fill; an electrically conductive coupler (18) comprising a plurality of turns (20) which are symmetrical about an axis of the electrically conductive coupler, the turns defining a volume (19) that at least partially contains the bulb; and a conductor (26) connected to a center portion of the electrically conductive coupler with connection of the conductor to the electrically conductive coupler providing a fixing of the coupler relative to the bulb which, when the conductor is connected to a source of RF electrical potential, conducts a RF current producing a RF electrical potential on the electrically conductive coupler that produces the RF electrical field coupled to the light emissive fill.

38 Claims, 6 Drawing Sheets

RADIO FREQUENCY DRIVEN ULTRA-VIOLET LAMP

BACKGROUND OF THE INVENTION

1. Field of the Invention

The invention relates to electrodeless lamps excited by radio frequency (RF) fields.

2. Description of the Prior Art

Numerous patents disclose electrodeless bulbs which are excited by RF energy using an electrically conductive coupler having one or more turns of an electrical conductor wrapped around the outside of the bulb. See U.S. Pat. Nos. 4,204,834, 4,792,725, 5,063,333, 5,070,277, 5,072,157, 5,130,612, 5,280,217, 5,306,987, 5,886,478, 5,923,116, 5,990,632, 6,046,545, 6,107,752, 6,137,237, 6,145,979, 6,248,805 and 6,249,090. Depending upon the design of the RF excitation system, the one or more turns of the electrically conductive coupler which excites the bulb operate based upon the principle of inductive and/or capacitive coupling to the electrodeless bulb.

Electrodeless lamp assemblies which are excited by an electrically conductive coupler having one or more turns of an electrical conductor wrapped around the bulb are highly advantageous in view of their ability to generate substantial light output in either the visible or ultra-violet (UV) range within a compact housing. However, a compact housing exacerbates cooling of the bulb and the one or more turns of the electrically conductive coupler which are in a fixed relationship to the bulb. Moreover, prevention of coupling of RF energy from the electrically conductive coupler through stray capacitance or inductance to the housing containing the electrodeless bulb is desirable to produce the maximum amount of optical output with the smallest input of RF power.

Furthermore, in applications utilizing a compact UV light generator, such as to reproduce photographs which are digitally stored, low operating temperature of outer walls of the housing of the UV lamp assembly is highly desirable. In most applications requiring a compact light source, the light source is a component in a larger machine. Thus, compactness and low operating temperature on the lamp surfaces are valuable because it allows the larger machine components to be made from inexpensive temperature sensitive materials, such as plastic, and further allows the components to be mounted in close proximity to the UV lamp contributing to the efficiency of the overall design.

SUMMARY OF THE INVENTION

The present invention provides a compact electrodeless lamp assembly which has high output in a selected part of the spectrum which is useful for diverse applications. The outer wall of the compact housing is maintained at a temperature during operation which will not burn.

The present invention further provides an optically reflective housing containing an electrodeless bulb which has minimal absorption of the light produced therein.

A lamp assembly in accordance with the invention utilizes an electrically conductive coupler which excites an electrodeless bulb comprising a plurality of turns which define a volume that at least partially contains the electrodeless bulb. A conductor is connected to a center portion of the electrically conductive coupler which fixes the coupler relative to the bulb.

The electrically conductive coupler provides a high efficiency coupling of the RF electrical field to the electrodeless bulb. The connection of the conductor to a center portion of the electrical coupler produces a symmetrical transfer of electrical power from the RF electrical field to the electrodeless bulb which ensures that power is dissipated uniformly in the electrodeless bulb which enhances efficiency and the life of the electrodeless bulb.

A lamp assembly in accordance with the invention includes an electrodeless bulb which is symmetrical about an axis and which contains a light emissive fill which emits light when the bulb is excited by a radio frequency electrical field coupled to the fill; an electrically conductive coupler comprising a plurality of turns which are symmetrical about an axis of the coupler, the turns defining a volume that at least partially contains the bulb; and a conductor connected to a center portion of the electrically conductive coupler with the connection of the conductor to the coupler providing a fixing of the coupler relative to the bulb which, when the conductor is connected to a source of radio frequency electrical potential, conducts a radio frequency current producing a radio frequency electrical potential on the electrically conductive coupler that produces the radio frequency electrical field coupled to the fill. The outer surface of the bulb may include a cylindrical section and the volume may include a cylindrical section. The axes may be substantially parallel and/or proximate to teach other. The conductor may be connected to one of the turns at a center portion of the electrically conductive coupler relative to ends thereof. Radio frequency power may be coupled symmetrically, relative to the center portion of electrically conductive coupler, to the fill. The plurality of turns may be a wire with a polygonal cross section which may be a triangle, a quadrilateral such as a square, or an equilateral polygon with more than four sides.

A lamp assembly in accordance with the invention includes an electrodeless bulb having an outer surface which is symmetrical about an axis and which contains a light emissive fill that emits light when the bulb is excited by a radio frequency electrical field coupled to the fill, an electrically conductive coupler comprising a plurality of turns which are symmetrical about an axis of the coupler, the turns defining a volume that at least partially contains the bulb, a conductor connected to a center portion of the electrically conductive coupler with the connecting of the conductor to the electrically conductive coupler providing a fixing of the coupler relative to the bulb which, when the conductor is connected to a source of radio frequency electrical potential, conducts a radio frequency current producing a radio frequency electrical potential on the electrically conductive coupler to produce the radio frequency electrical field coupled to the fill; and a light reflective chamber which contains the bulb, the electrically conductive coupler and the conductor, the chamber including a center section which reflects light emitted from the bulb out of an opening in the chamber, a top section and a bottom section and each of the top and bottom sections reflecting light emitted from the bulb and reflected from another of the top and bottom sections. The top and bottom sections may each include curved light reflective indentations which receive an end of the bulb and are indented in an outward manner relative to the chamber so that surfaces of the indentations are spaced further apart than remaining surfaces of the top and bottom sections which are not indented and the curved indentations reflect light emitted from the bulb. The lamp assembly may further include a housing containing the chamber, and at least one fan located in one end of the housing which inducts air from one end of the housing and blows the inducted air into contact with outer surfaces of the sections of the chamber and inner surfaces of the housing and then outwardly from the housing and blows air into the chamber past the bulb and the electrical coil and outwardly from the opening in the chamber. The housing may have sections which are joined together to define the one end and may include another end which surrounds the opening of the chamber and each section may include at least one opening located remote from the one end from which air is blown outwardly by the fan after cooling the sections of the chamber and the housing. The housing may comprise plastic. A plurality of fans may be located at the one end of the housing. The conductor may be connected to one of the turns substantially at a center portion of the electrically conductive coupler relative to ends thereof. Radio frequency power may be coupled symmetrically, relative to the center portion of the electrically conductive coupler, to the fill. The plurality of turns may be a wire with a polygonal cross section which may be a triangle, a quadrilateral such as a square, or an equilateral polygon with more than four sides.

A lighting system in accordance with the invention includes a plurality of lamp assemblies which are connected together, each lamp assembly comprising an electrodeless bulb having an outer surface which is symmetrical about an axis and which contains a light emissive fill which emits light when the bulb is excited by a radio frequency electrical field coupled to the fill, an electrically conductive coupler comprising a plurality of turns which are symmetrical about an axis of the coupler, the turns defining a volume that at least partially contains the bulb, a conductor connected to a center portion of the electrically conductive coupler with the connecting of the conductor to the electrically conductive coupler providing a fixing of the coupler relative to the bulb which, when the conductor is connected to a source of radio frequency electrical potential, conducts a radio frequency current producing a radio frequency electrical potential on the electrically conductive coupler to produce the radio electrical frequency field coupled to the light emissive fill; and a light reflective chamber which contains the bulb, the electrically conductive coupler and the conductor, the chamber including a center section which reflects light emitted from the bulb out of an opening in the chamber, a top section and a bottom section and each of the top and bottom sections reflecting light emitted from the bulb and reflected from another of the top and bottom sections.

BRIEF DESCRIPTION OF THE DRAWINGS

Like reference numerals identify like parts throughout the drawings.

DESCRIPTION OF THE PREFERRED EMBODIMENTS

Figure 1:
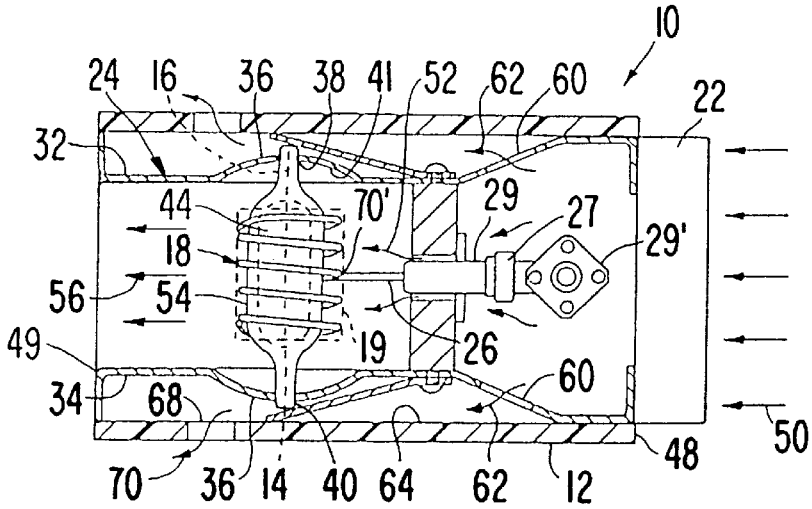
FIG. 1 illustrates a side elevational view of a first embodiment of the present invention.
Figure 2:
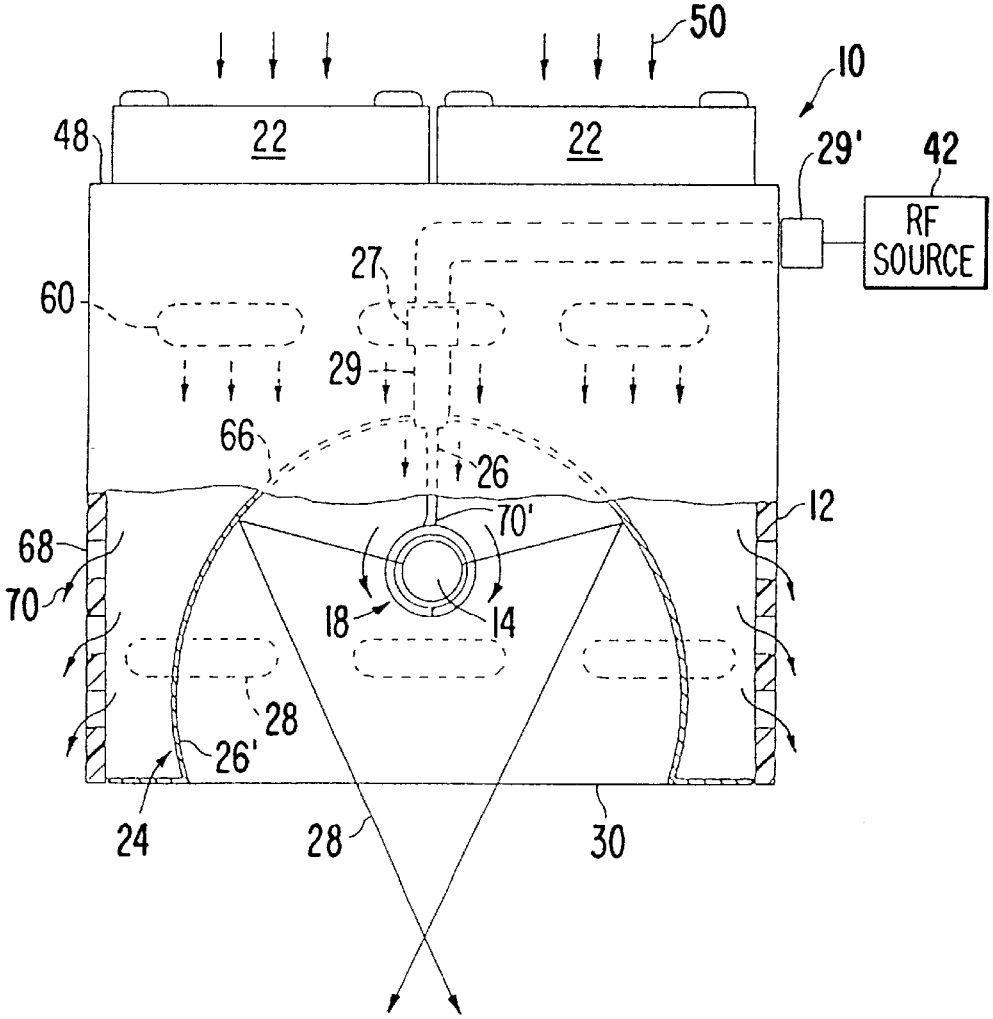
FIG. 2 illustrates a top view of the embodiment of FIG. 1.
Figure 3:
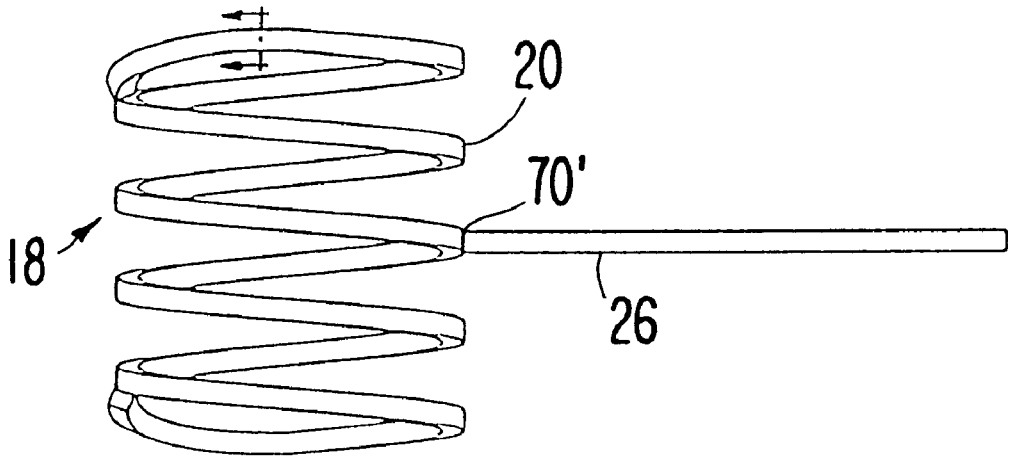
FIG. 3 illustrates a view of a conductor connected to an electrically conductive coupler used for exciting an electrodeless bulb in accordance with the present invention.
Figure 4:
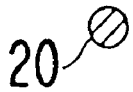
FIGS. 4–7 respectively illustrate different cross sections of the wire of FIG. 3 which may be utilized to form the electrically conductive coupler.

FIGS. 1–9 illustrate a first embodiment 10 of a lamp assembly in accordance with the invention. The lamp assembly of FIGS. 1–9 provides high optical output from an electrodeless bulb 14 excited from a source of RF electrical potential 42 enclosed by a spatially compact housing 12 which may be manufactured from plastic in view of the efficient cooling mechanism of the present invention, which is described below, that is provided during operation of the lamp assembly. The electrodeless bulb 14 is described in more detail hereinbelow and is symmetrical about axis 16. The electrodeless bulb 14 is excited by an RF electrical field provided from an electrically conductive coupler 18 illustrated in detail in FIG. 3. The electrically conductive coupler comprises a plurality of turns 20 of wire which define a cylinder 19 that is also symmetrical about axis 16. In general, the axes of the electrodeless bulb 14 and the cylinder 19 are preferably coaxial and are desirably substantially coincident and/or parallel so that the volume of the cylinder 19 at least partially contains the electrodeless bulb as illustrated so that the RF electrical field is coupled fully along a major axis of the electrodeless bulb.

A light reflective and electrically conductive chamber 24, which may be manufactured from aluminum or another metal, such as stainless steel, contains the electrodeless bulb 14, electrical coupler 18, and an electrical conductor 26, which is connected at connection point 70' to a center portion of the electrical coupler 18. Fitting 27 includes an insulative sleeve 29 preventing the flow of RF current at the location the electrical conductor 26 passes through the end wall of the center section of the electrically grounded chamber 24. Fitting 29' is used to make connection to the RF source 42. The connection 70' of the electrical conductor 26 to the electrically conductive coupler 18 fixes the coupler relative to the electrodeless bulb 14. The center section 26' of the electrically grounded and conductive chamber 24 reflects light 28 emitted from the electrodeless bulb 14 out of an opening 30. The top section 32 and a bottom section 34 of the chamber 24 are joined to the center section 26' to complete the light reflective enclosure of the reflective chamber. The top section 32 and the bottom section 34 may be parallel or canted relative to each other so that the relative spacing diverges toward the opening of the chamber. Each of the top and bottom sections 32 and 34 respectively contain a reflective outwardly extending indentation 36 and an aperture 38 through which end 40 of the electrodeless bulb 14 passes which retains the bulb in a fixed position relative to the chamber 24. The inner surface 41 of the indentations 36 reflects light emitted from the end portion of the electrodeless bulb 14 and the light reflected from another of the top and bottom sections.

Tests have shown that the indentations 36 increase the optical output power by approximately 5% for a constant RF input power from RF source 42 in comparison to when the indentations 36 are not used. Furthermore, since the exciting of the electrodeless bulb 14 relies upon capacitive coupling of an RF electrical field from the electrically conductive coupler 18 to the fill inside of the electrodeless bulb, the spacing of the indentations 36 as far away as practical from the inner envelope 44 of the electrodeless bulb decreases the stray capacitance and undesirable coupling of RF energy to the grounded chamber 24. Preventing coupling of the RF energy directly to the grounded chamber 24 causes a more efficient conversion of RF energy into the emission of visible light 28 than occurs in the absence of the indentations 36.

At least one fan 22 is located at one end 48 of the housing 12. The at least one fan 22 inducts air 50 into the housing 12 which is blown into the space between the inner walls of the housing 12 and the outer walls of the chamber 24 and also into the chamber past the electrodeless bulb 14 and the electrically conductive coupler. The air 56 exits the other end 49.

The inducted air 50 is split into separate paths. A first path flows into the interior of the light reflective chamber 24 as indicated by arrows 52 and past the turns 20 of the electrically conductive coupler 18 and an outer surface 54 of the electrodeless bulb 14 to provide substantial cooling. The first path of air exits the interior of the chamber 24 from the far end 53 as airflow 56. A second path of inducted air 50 is through aperture 60 in the top and bottom sections 32 and 34 of the chamber 24. Airflow 62, upon passing through apertures 60, cools the outer surface of the top and bottom sections 32 and 34 and the inner surface 64 of the plastic housing to cool the outer wall of the plastic housing 12 to a temperature that a person touching the wall will not suffer burning. A third path of inducted air 50 (FIG. 2), is against the outside wall 66 of the center section 26' of the chamber 24 and then out through apertures 68 as airflow 70. As a result of the foregoing airflows, an extremely efficient cooling of both the electrodeless bulb 14 and the associated electrically conductive coupler 18, the walls of the light reflective chamber 24 and the walls of the compact housing 12 containing the chamber occurs.

FIGS. 3–7 illustrate a more detailed view of the electrically conductive coupler 18 and connected conductor 26 including possible cross-sections shapes of the turns 20 of the wire which are illustrated in FIGS. 4–7. While the connection 70' of the electrical conductor 26 to the turns of wire 20 is shown to be perfectly symmetrical relative to the ends in FIG. 3, it should be understood that the invention is not limited to connection to the center of the cylinder 19 defined by the turns 20 and may, for example, be connected at points outboard from the center but remote from the ends as long as the RF field coupling provides sufficient excitation to the electrodeless bulb 14 for the desired application. The closer the point(s) of connection 70' to the center of the conductor 26, the more symmetrical the flow of power to the electrodeless bulb 14 is from the hottest center operating portion to the coolest endpoints which is the most desirable operating characteristic to be utilized with the lamp assembly of the present invention.

Figure 5:
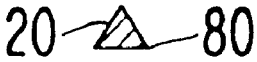
Figure 6:
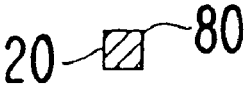
Figure 7:
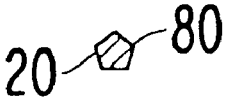
Figure 8:
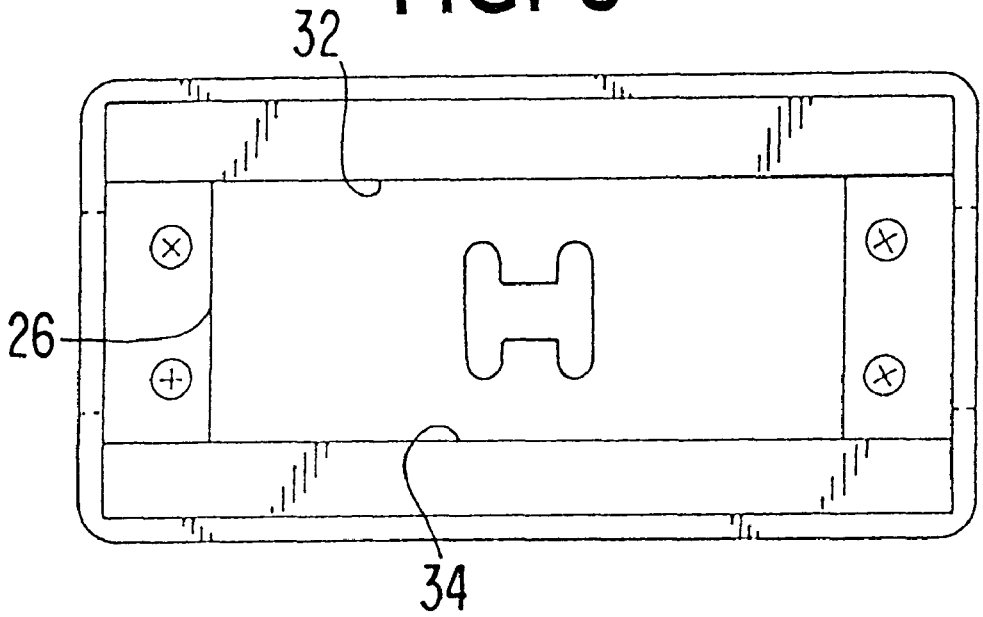
FIG. 8 illustrates a front elevational view of the first embodiment with the electrodeless bulb and electrically conductive coupler and conductor removed.
Figure 9:
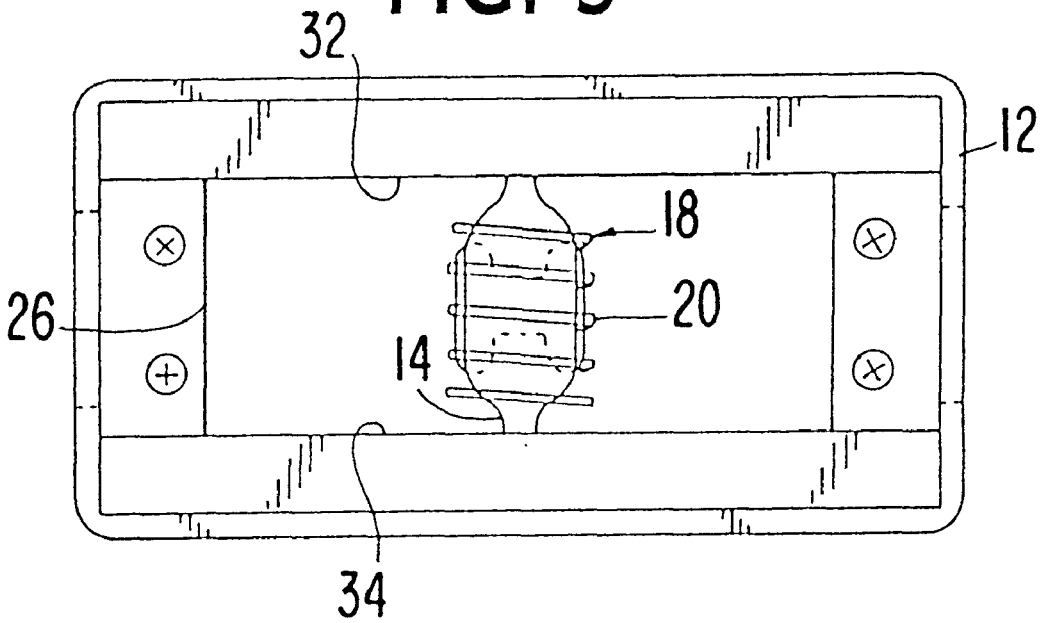
FIG. 9 illustrates a front elevational view of the first embodiment which illustrates the electrodeless bulb and electrically conductive coupler in place.

The non-circular cross sections of FIGS. 5–7, which may be utilized to manufacture the electrically conducting coupler 18, have two advantages over a circular cross section. First, the corners 80 concentrate the electrical field which may facilitate the electrical coupling of the electrical field from the electrically conductive coupler 18 to the electrodeless bulb 14. Furthermore, the overall mechanical stability of the wire may be increased by the non-circular cross section.

Figure 10:
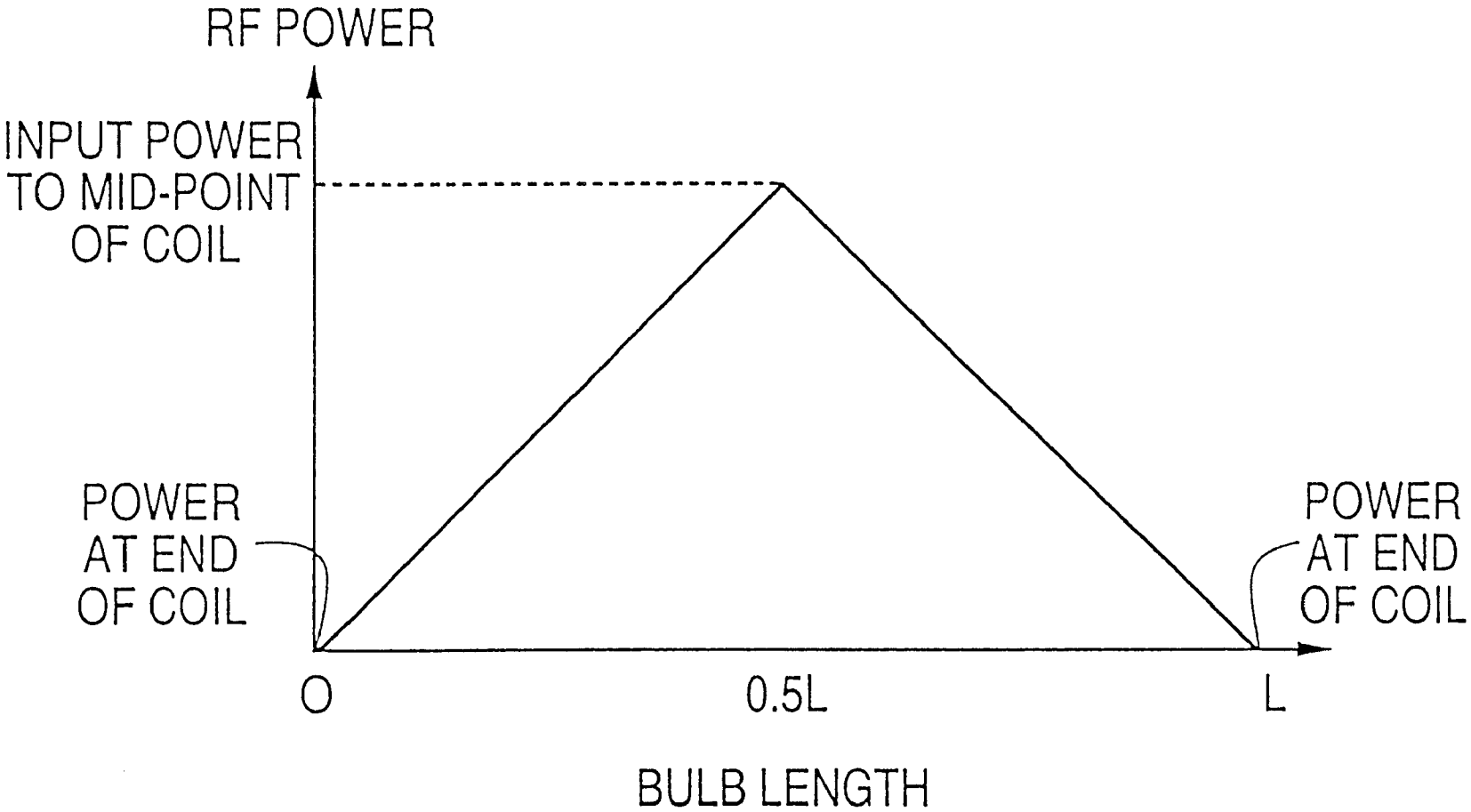
FIG. 10 is a graph of the transfer of electrical power from the electrically conductive coupler to the electrodeless bulb along the length of the electrodeless bulb.

FIG. 10 illustrates a graph of the coupling of RF power produced by RF source 42 by conduction through the electrically conducting coupler 18 to the electrodeless bulb 14. The Y axis indicates the level of input RF power applied to the axis 16 of the electrodeless bulb 14. The origin is at one end of the electrodeless bulb 14 and "L" is at another end of the electrodeless bulb. The connection of the RF electrical potential substantially at the midpoint, such as point 70' of FIG. 3, results in the gradient of energy absorption along the length of the bulb from the maximum at the midpoint to the minimum at the ends which operate at the colder temperatures.

Coupling of the RF electrical field substantially at the midpoint of the electrically conductive coupler 18 results in the most uniform dissipation of power along the length of the electrodeless bulb 14 which prolongs the life of the bulb. For example, if the RF electrical potential from the RF source 42 is coupled to one end of the bulb, the result is that the end to which the RF electrical potential is coupled operates at the highest temperature with the far end operating at the lowest temperature. As a result, there is a greater temperature differential between the hottest point on the electrodeless bulb 14 and the coldest point on the electrodeless bulb 14 which may be deleterious to bulb life.

Figure 11:
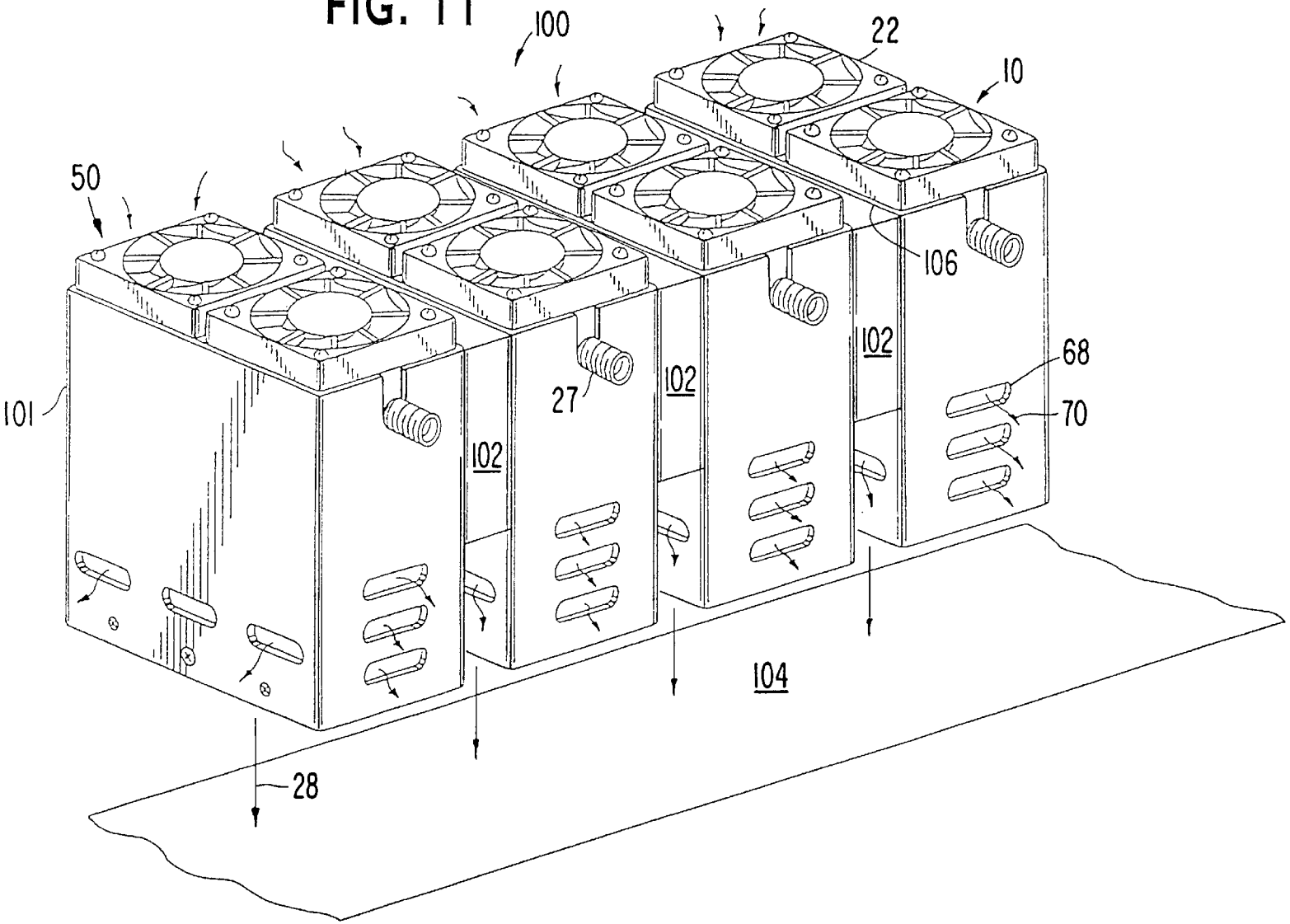
FIG. 11 illustrates a second embodiment of the present invention in which a group of lamp assemblies in accordance with the first embodiment are connected together to irradiate a target.

FIG. 11 illustrates a second embodiment 100 of the present invention which is a lighting system. The lighting system is comprised of a group of individual lamp assemblies of FIGS. 1–9, that are joined together by a connecting mechanism 101 which may be of any desired design. Spacing 102 of the individual lamp assemblies 10 apart permits the cooling airflow as described above to flow between adjacent individual lamp assemblies to promote cooling of the adjacent walls 106. As illustrated, the group of individual lamp assemblies, when ganged together by the connecting mechanism 101, permit the illumination of a target 104 which may contain objects requiring UV curing, such as those moving along a conveyor belt.

Figure 12:
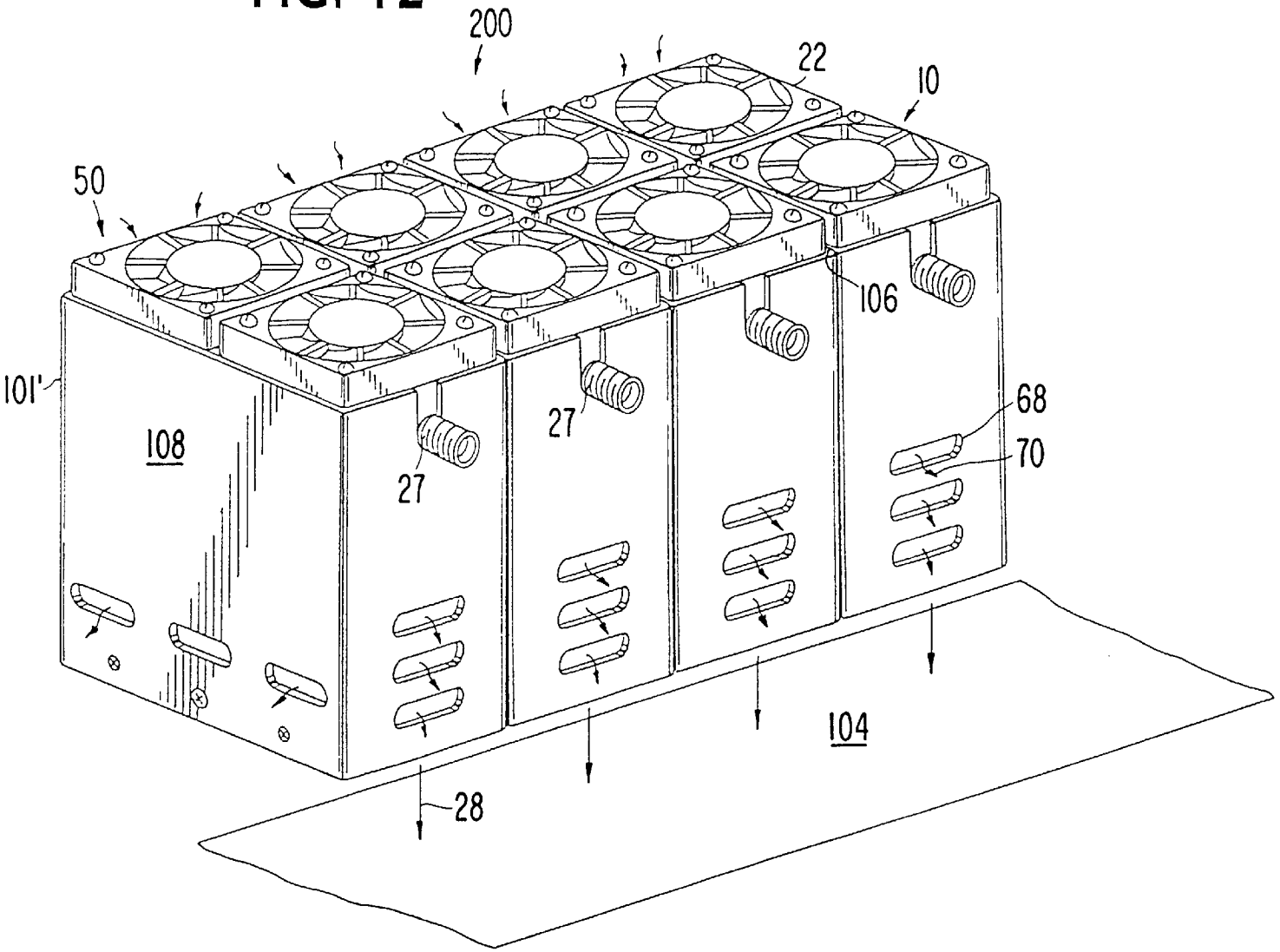
FIG. 12 illustrates a third embodiment of the present invention similar to the second embodiment except that the adjacent lamp assemblies are touching each other.

FIG. 12 illustrates a third embodiment 200 of the present invention, which is similar to the second embodiment. Unlike the second embodiment 100, the adjacent walls 106 of the third embodiment 200 are touching which positions the walls 106 as interior walls 108. The positioning of the adjacent walls 106 in contact by the connecting mechanism 101' is permissible as long as the choice of the material from which the walls are made is thermally stable with the application.

The electrodeless bulb 14 of the preferred embodiment is constructed of materials that are standard in the art.

The following is an example of the preferred embodiment of the present invention which may be used in a commercial application to generate UV light in a configuration as illustrated in FIGS. 1–3 and 6–12.

The outer diameter of the electrodeless bulb 14 is 9 mm and the overall length is approximately 0.8 inches. The electrically conductive coupler 18 is preferably composed of nickel, and may be composed of any other conductive material that is able to withstand high temperature operation, such as stainless steel, titanium, or other commercial alloys. The cross-section of the electrically conductive coupler is preferably square, but may be triangular, polygonal, or circular. The electrically conductive coupler is in the form of an approximately six-turn coil, with an inner diameter of approximately 12.5 mm. The overall height of the electrically conductive coupler is approximately 0.75 inches. The electrically conductive coupler 18 and electrodeless bulb 14 are positioned inside the light reflective chamber 24. The top 32 and bottom 34 sections of the light reflective chamber 24 are parallel and spaced approximately one inch apart at the opening of the chamber.

In this example, the electrically conductive coupler couples RF energy to the electrodeless bulb at a frequency of about 600 MHz. Increasing the number of turns on the electrically conductive coupler, or increasing the pitch of the turns tends to lower the RF frequency at which RF power is efficiently coupled to the bulb. Increasing the diameter of the turns comprising the electrically conductive coupler tends to decrease the frequency at which RF power coupled to the electrodeless bulb, and also decreases the coupling efficiency. Decreasing the diameter of the electrically conductive coupler can increase the coupling efficiency. However, manufacturing concerns must be taken into account as the electrically conductive coupler cannot be permitted to touch the bulb which causes localized overheating at the point of contact and rapid bulb failure.

The configuration of the example may be scaled for longer bulbs, several inches in length; larger diameter bulbs, up to at least 15 mm or more; and electrically conductive couplers turned to RF frequencies ranging from 100 MHz to more than 1000 MHz.

While a preferred application of the present invention is the generation of UV light, it should be understood that the present invention is not limited thereto. For example, the fill within the electrodeless bulb 14 may be varied to change the characteristics of light emission to suit particular applications requiring particular frequencies of light.

What is claimed is:

1. A lamp assembly comprising:

an electrodeless bulb which is symmetrical about an axis and which contains a light emissive fill which emits light when the bulb is excited by a radio frequency field coupled to the fill;

an electrically conductive coupler comprising a plurality of turns which are symmetrical about an axis of the coupler, the turns defining a volume that at least partially contains the bulb; and a conductor connected to a center portion of the electrically conductive coupler with the connection of the conductor to the coupler providing a fixing of the coupler relative to the bulb which, when the conductor is connected to a source of radio frequency electrical potential, conducts a radio frequency current producing a radio frequency electrical potential on the electrically conductive coupler that produces the radio frequency field coupled to the fill.

2. A lamp assembly in accordance with claim 1 wherein:

the outer surface of the bulb includes a cylindrical section; and the volume includes a cylindrical section.

3. A lamp assembly in accordance with claim 2 wherein:

the axes are substantially parallel.

4. A lamp assembly in accordance with claim 3 wherein:

the conductor is connected to one of the turns at a center portion of the electrically conductive coupler relative to ends thereof.

5. A lamp assembly in accordance with claim 4 wherein:

radio frequency power is coupled symmetrically, relative to the center portion of electrically conductive coupler, to the fill.

6. A lamp assembly in accordance with claim 2 wherein:

the conductor is connected to one of the turns at a center portion of the electrically conductive coupler relative to ends thereof.

7. A lamp assembly in accordance with claim 6 wherein:

radio frequency power is coupled symmetrically, relative to the center portion of electrically conductive coupler, to the fill.

8. A lamp assembly in accordance with claim 1 wherein:

the axes are substantially parallel.

9. A lamp assembly in accordance with claim 8 wherein:

the conductor is connected to one of the turns at a center portion of the electrically conductive coupler relative to ends thereof.

10. A lamp assembly in accordance with claim 9 wherein:

radio frequency power is coupled symmetrically, relative to the center portion of electrically conductive coupler, to the fill.

11. A lamp assembly in accordance with claim 1 wherein:

the conductor is connected to one of the turns at a center portion of the electrically conductive coupler relative to ends thereof.

12. A lamp assembly in accordance with claim 11 wherein:

radio frequency power is coupled symmetrically, relative to the center portion of electrically conductive coupler, to the fill.

13. A lamp assembly in accordance with claim 11 wherein:

the plurality of turns are a wire with a polygonal cross section.

14. A lamp assembly in accordance with claim 13 wherein:

the polygonal cross section is a triangle.

15. A lamp assembly in accordance with claim 13 wherein:

the polygonal cross section is a quadrilateral.

16. A lamp assembly in accordance with claim 13 wherein:

the polygonal cross section is an equilateral polygon with more than four sides.

17. A lamp assembly in accordance with claim 1 wherein:

the plurality of turns are a wire with a polygonal cross section.

18. A lamp assembly in accordance with claim 17 wherein:

the polygonal cross section is a triangle.

19. A lamp assembly in accordance with claim 17 wherein:

the polygonal cross section is a quadrilateral.

20. A lamp assembly in accordance with claim 17 wherein:

the polygonal cross section is an equilateral polygon with more than four sides.

21. A lamp assembly comprising:

an electrodeless bulb having an outer surface which is symmetrical about an axis and which contains a light emissive fill which emits light when the bulb is excited by a radio frequency field coupled to the fill, an electrically conductive coupler comprising a plurality of turns which are symmetrical about an axis of the coupler, the turns defining a volume that at least partially contains the bulb, a conductor connected to a center portion of the electrically conductive coupler with the connection of the conductor to the electrically conductive coupler providing a fixing of the coupler relative to the bulb which, when the conductor is connected to a source of radio frequency electrical potential, conducts a radio frequency current producing a radio frequency electrical potential on the electrically conductive coupler to produce the radio frequency field coupled to the light emissive fill; and a light reflective chamber which contains the bulb, the electrically conductive coupler and the conductor, the chamber including a center section which reflects light emitted from the bulb out of an opening in the chamber, a top section and a bottom section and each of the top and bottom sections reflecting light emitted from the bulb and reflected from another of the top and bottom sections.

22. An assembly in accordance with claim 21 wherein:

the top and bottom sections include curved light reflective indentations which receive an end of the bulb and are indented in an outward manner relative to the chamber so that surfaces of the indentations are spaced further apart than remaining surfaces of the top and bottom sections which are not indented and the curved indentations reflect light emitted from the bulb.

23. A lamp assembly in accordance with claim 22 comprising:

a housing containing the chamber; and at least one fan located in one end of the housing which inducts air from one end of the housing and blows the air into contact with outer surfaces of the sections of the chamber and inner surfaces of the housing and then outwardly from the housing and also blows air into the chamber past the bulb and an electrical coil and outwardly from an opening in the chamber.

24. A lamp assembly in accordance with claim 23 wherein:

the housing has sections which are joined together to define the one end and another end which surrounds the opening the chamber and each section including at least one opening located remote from the one end from which air is blown outwardly by the fan after cooling the sections of the chamber and the housing.

25. A lamp assembly in accordance with claim 24 wherein:

the housing comprises plastic.

26. A lamp assembly in accordance with claim 23 wherein:

the housing comprises plastic.

27. An assembly in accordance with claim 21 comprising:

a housing containing the chamber, and at least one fan located in one end of the housing which inducts air from one end of the housing and blows the inducted air into contact with outer surfaces of the sections of the chamber and inner surfaces of the housing and then outwardly from the housing and blows air into the chamber past the bulb and an electrical coil and outwardly from the opening in the chamber.

28. A lamp assembly in accordance with claim 27 wherein:

the housing comprises plastic.

29. A lamp assembly in accordance with claim 27 wherein:

the housing has sections which are joined together to define the one end and includes another end which surrounds the opening of the chamber and each section including at least one opening located remote from the one end from which air is blown outwardly by the fan after cooling the sections of the chamber and the housing.

30. A lamp assembly in accordance with claim 29 wherein:

the housing comprises plastic.

31. A lamp assembly in accordance with claim 21 wherein:

a plurality of fans are located at the one end.

32. A lamp assembly in accordance with claim 21 wherein:

the conductor is connected to one of the turns substantially at a center portion of the electrically conductive coupler relative to ends thereof.

33. A lamp assembly in accordance with claim 32 wherein:

radio frequency power is coupled symmetrically, relative to the center portion of the electrically conductive coupler, to the fill.

34. A lamp assembly in accordance with claim 21 wherein:

the plurality of turns are a wire with a polygonal cross section.

35. A lamp assembly in accordance with claim 34 wherein:

the polygonal cross section is a triangle.

36. A lamp assembly in accordance with claim 35 wherein:

the polygonal cross section is an equilateral polygon with more than four sides.

37. A lamp assembly in accordance with claim 34 wherein:

the polygonal cross section is a quadrilateral.

38. A lighting system comprising:

a plurality of lamp assemblies which are connected together, each lamp assembly comprising an electrodeless bulb having an outer surface which is symmetrical about an axis and which contains a light emissive fill which emits light when the bulb is excited by a radio frequency electrical field coupled to the fill, an electrically conductive coupler comprising a plurality of turns which are symmetrical about an axis of the coupler, the turns defining a volume that at least partially contains the bulb, a conductor connected to a center portion of the electrically conductive coupler with the connection of the conductor to the electrically conductive coupler providing a fixing of the coupler relative to the bulb which, when the conductor is connected to a source of radio frequency electrical potential, conducts a radio frequency current producing a radio frequency electrical potential on the electrically conductive coupler to produce the radio frequency electrical field coupled to the light emissive fill; and a light reflective chamber which contains the bulb, the electrically conductive coupler and the conductor, the chamber including a center section which reflects light emitted from the bulb out of an opening in the chamber, a top section and a bottom section and each of the top and bottom sections reflecting light emitted from the bulb and reflected from another of the top and bottom sections.

* * * * *